US012326070B2

(12) United States Patent
Smith et al.

(10) Patent No.: US 12,326,070 B2
(45) Date of Patent: Jun. 10, 2025

(54) APPARATUS AND RELATED METHODS FOR THE CEMENT BREAKUP DURING ABANDONMENT OPERATIONS

(71) Applicant: Owen Oil Tools LP, Houston, TX (US)

(72) Inventors: Craig Smith, Houston, TX (US); Stanley McCombie, Houston, TX (US); Shaun Geerts, Joshua, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 18/282,771

(22) PCT Filed: Mar. 17, 2022

(86) PCT No.: PCT/US2022/020784
§ 371 (c)(1),
(2) Date: Sep. 18, 2023

(87) PCT Pub. No.: WO2022/197946
PCT Pub. Date: Sep. 22, 2022

(65) Prior Publication Data

US 2024/0167367 A1 May 23, 2024

Related U.S. Application Data

(60) Provisional application No. 63/163,461, filed on Mar. 19, 2021.

(51) Int. Cl.
*E21B 43/117* (2006.01)
*E21B 29/10* (2006.01)

(52) U.S. Cl.
CPC ..... *E21B 43/117* (2013.01); *E21B 29/10* (2013.01)

(58) Field of Classification Search
CPC ..... E21B 43/116; E21B 43/117
See application file for complete search history.

(56) References Cited

U.S. PATENT DOCUMENTS

| | | | | |
|---|---|---|---|---|
| 5,131,465 | A | 7/1992 | Langston | |
| 2004/0231840 | A1 | 11/2004 | Ratanasirigulchai et al. | |
| 2017/0167224 | A1* | 6/2017 | Holder | E21B 34/066 |
| 2017/0167233 | A1 | 6/2017 | Sampson et al. | |
| 2020/0325746 | A1* | 10/2020 | Lerbrekk | E21B 33/13 |
| 2022/0170337 | A1* | 6/2022 | Melhus | E21B 43/116 |
| 2024/0247564 | A1* | 7/2024 | Varhaug | E21B 33/14 |

FOREIGN PATENT DOCUMENTS

WO 2020016169 A1 1/2020

OTHER PUBLICATIONS

PCT/US2022/020784; WO and ISR dtd May 22, 2022; 13 pp.

* cited by examiner

*Primary Examiner* — Giovanna Wright
(74) *Attorney, Agent, or Firm* — Crowe & Dunlevy, P.C.

(57) ABSTRACT

A method of remediation includes positioning a well tool in a bore of the first wellbore tubular, the well tool having at least one shaped charge and at least one propellant body. The method further includes detonating the shaped charge to generate a jet that forms an opening in a first wellbore tubular and a tunnel at least partially in a cement body, but does not form an opening in a second wellbore tubular. The method also includes igniting the propellant body to generate a gas at a volume and pressure selected to disintegrate the cement body.

17 Claims, 10 Drawing Sheets

APPARATUS AND RELATED METHODS FOR THE CEMENT BREAKUP DURING ABANDONMENT OPERATIONS

BACKGROUND OF THE DISCLOSURE

1. Field of Disclosure

The present disclosure relates to an apparatus and method for breaking up the cement surrounding an oil well tubular.

2. Description of the Related Art

Hydrocarbon producing wells typically include a casing string positioned within a wellbore that intersects a subterranean oil or gas deposit. The casing string increases the integrity of the wellbore and provides a path for producing fluids to the surface. In some subsurface production structures, two or more telescopically arranged tubulars are connected using cement.

Sometimes it is desirable to break up the cement connecting the two tubulars. By way of example, the sealing capability of the cement may be inadequate. Obtaining the desired sealing capability may require the removal of the existing cement. In another example, it may be desirable to extract or pull one or more of the wellbore tubulars from the wellbore. To do so may require that the existing cement be broken up in order to free one or more of the wellbore tubulars. The present disclosure address the need to break up cement surrounding a casing string or other oil well tubular as well as other needs of the prior art.

SUMMARY OF THE DISCLOSURE

In aspects, the present disclosure provides a method of remediation in a subterranean formation having a borehole in which a first wellbore tubular is disposed at least partially within a second tubular. a cement body may connect the first wellbore tubular to the second wellbore tubular. The method may include: positioning a well tool in a bore of the first wellbore tubular, the well tool having at least one shaped charge and at least one propellant body; detonating the shaped charge to generate a jet that forms an opening in the first wellbore tubular and a tunnel at least partially in the cement body, but does not form an opening in the second wellbore tubular; and igniting the propellant body to generate a gas at a volume and pressure selected to disintegrate the cement body.

In aspects, the present disclosure also provides an apparatus for such remediating. The apparatus may include a carrier; a plurality of perforating charges disposed in the carrier and configured to only penetrate through the first tubular and at least partially through the cement; at least one puncturing charge disposed in the carrier and configured to penetrate only through the carrier, wherein the number of at least one puncturing charges is less that the number of perforating charges; and a propellant body disposed in the carrier and configured to be detonated by the at least one puncturing charge.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
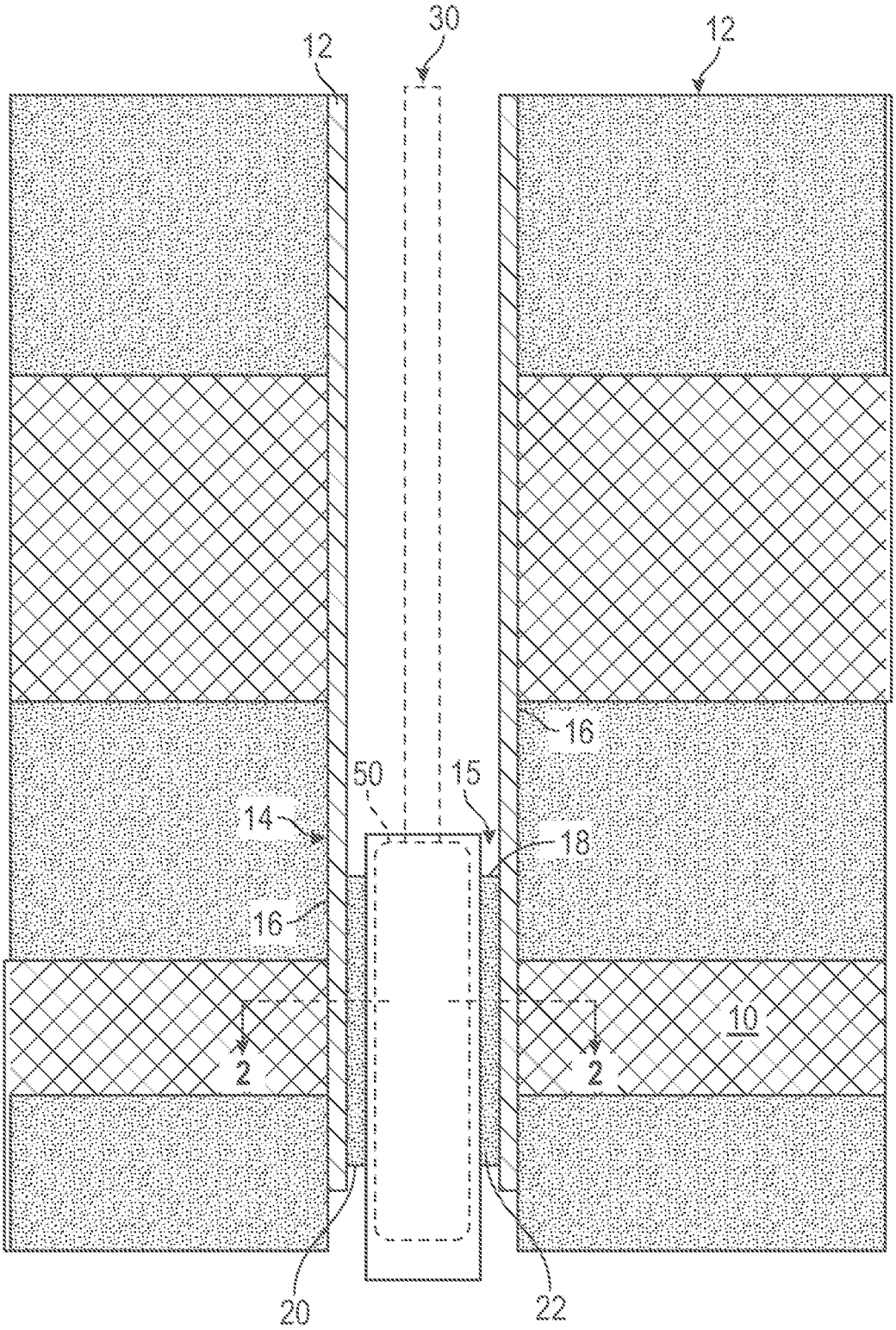
FIG. 1 is a schematic elevation view of a production structure having two or more telescoping wellbore tubulars connected by cement.

Referring to FIG. 1, there is shown a subsurface formation 10 in which a borehole 12 has been formed. A production string 14 is disposed in the wellbore 12. The production string 14 may include a joint 15 having an outer tubular 16 separated from an inner tubular 18 by an annular space 20. The cement 22 may reside in the annular space 20 and connect the tubulars 16, 18. By "connect," it is meant form a physical connection that prevents relative movement between the tubulars 16, 18. Also, a production string 14 is merely an illustrative well structure that may include a joint 15. Thus, the present teachings are not limited to only production strings 14.

Figure 2:
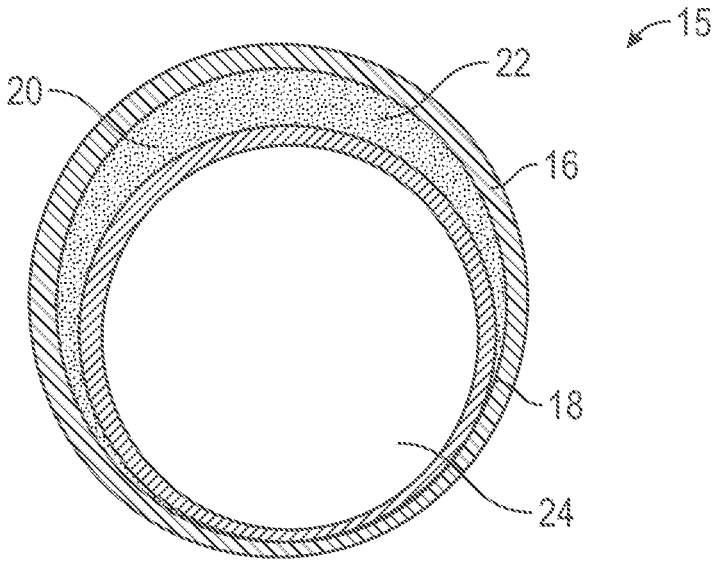
FIG. 2 is a sectional view of two telescoping wellbore tubulars connected by cement.

Referring to FIG. 2, there is shown a cross-sectional view of the joint 15. In this non-limiting arrangement, the cement 22 resides in the annular space 20 and connects the tubulars 16, 18. A flow bore 24 may convey fluid between the reservoir and the surface. It should be noted that the tubulars 16, 18 are eccentrically oriented to one another. In other situations, the tubulars 16, 18 may have a more concentric relative orientation.

Figure 3:
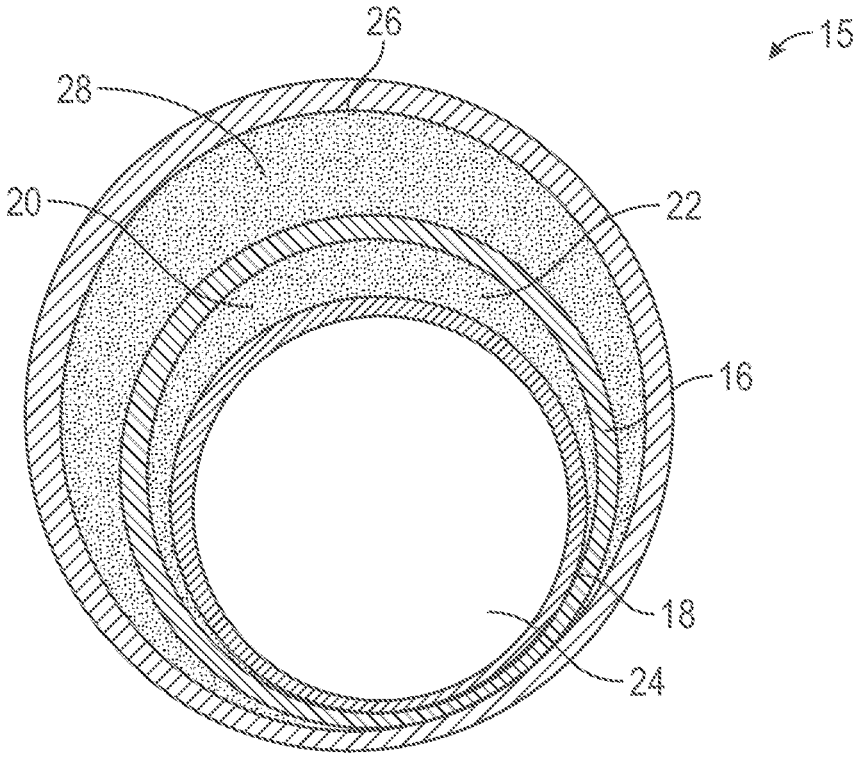
FIG. 3 is a sectional view of three telescoping wellbore tubulars connected by cement.

Referring to FIG. 3, there is shown a cross-sectional view of another joint 15 that has three telescopically arranged tubulars, 16, 18, 26. In this non-limiting arrangement, the cement 22 resides in the annular space 20 and connects the tubulars 16, 18 and also in an annular space 28 and connects tubulars 16, 26. A flow bore 24 may convey between the reservoir and the surface. It should be noted that the tubulars 16, 18, 26 are eccentrically oriented to one another. In other situations, two or more of the tubulars 16, 18, 26 may have a more concentric relative orientation.

A method of physically disconnecting adjacent wellbore tubulars connected by cement will be described with reference to FIG. 4A-B, which shows wellbore tubulars 16, 18 connected by cement 22. It should be understood that the two wellbore tubulars may also be wellbore tubulars 16, 26 (FIG. 3). The two wellbore tubulars 16, 18 are structurally disconnected from one another by first puncturing one of the wellbore tubulars and then breaking up the cement using a high pressure gas.

Figure 4A:
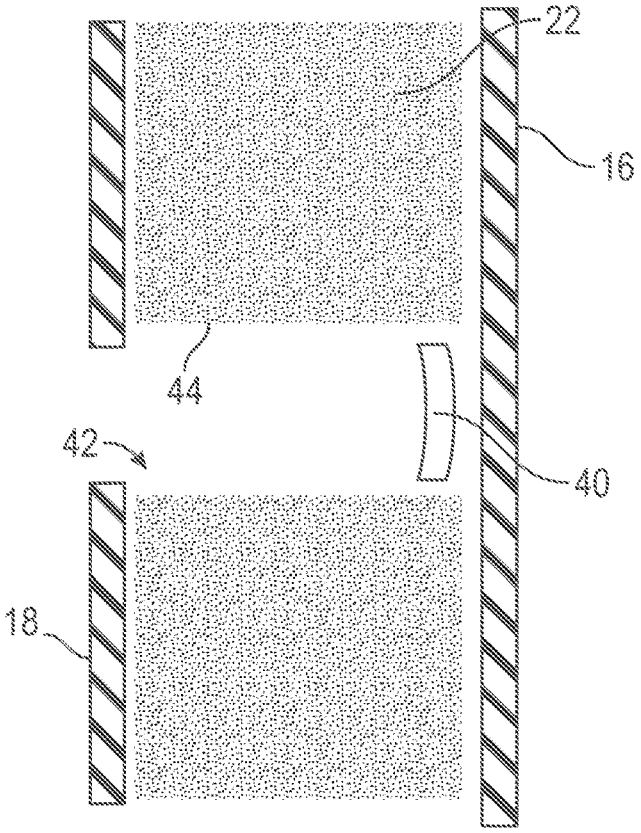
FIGS. 4A-B are side sectional views illustrating a method for disintegrating cement connecting two wellbore tubulars according to one embodiment of the present disclosure.

Referring to FIG. 4A, a shaped charge (not shown) may be ignited to generate a perforating jet 40 that creates an opening 42 in the inner wellbore tubular 18 and forms a tunnel 44 through the body of the cement 22. In embodiments, the perforating jet 40 does not penetrate through the outer wellbore tubular 16.

Figure 4B:
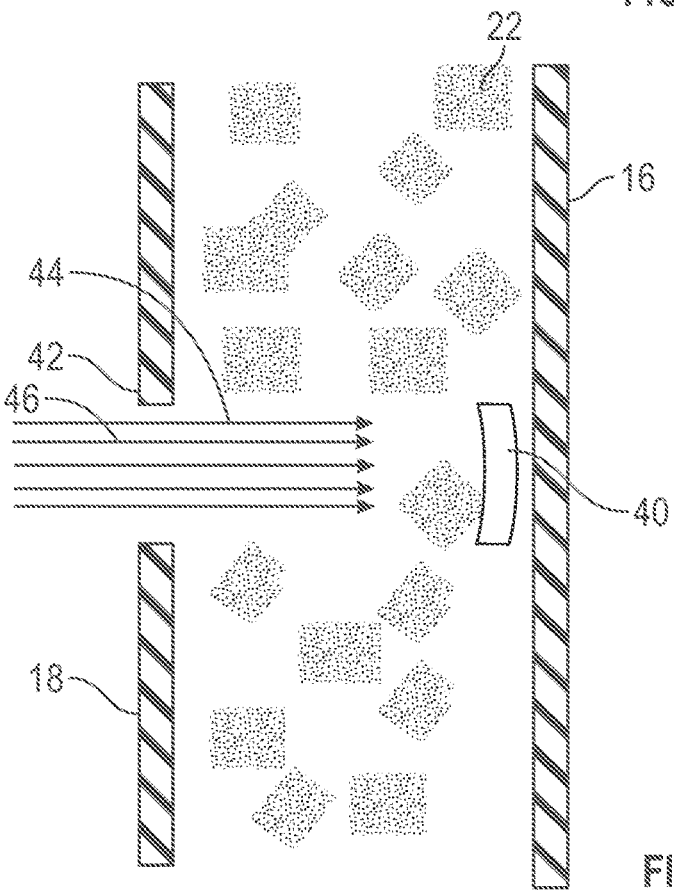

Referring to FIG. 4B, a propellant material (not shown) may be used to generate a high pressure gas 46 that flows through the opening 42 and into the tunnel 44. The high pressure gas 46 pressurizes and breaks up the cement 22. The cement 22 is disintegrated, i.e., broken up into particles, to a degree that relative opposing tension between the wellbore tubulars 16, 18 breaks up any remaining solid cement 22 and allows free axial relative movement of the wellbore tubulars 16, 18. The cement 42 does not have be completely broken up to physically disconnect the wellbore tubulars 16, 18. By "disintegrated," "broken up," "particulated," "rubblized," or "pulverized," it is meant that a body of cement 42 that was initially was integral or solid is now made of discrete particles that are not bonded, affixed, or otherwise rigidly attached to one another, or "free particles."

Figure 4C:
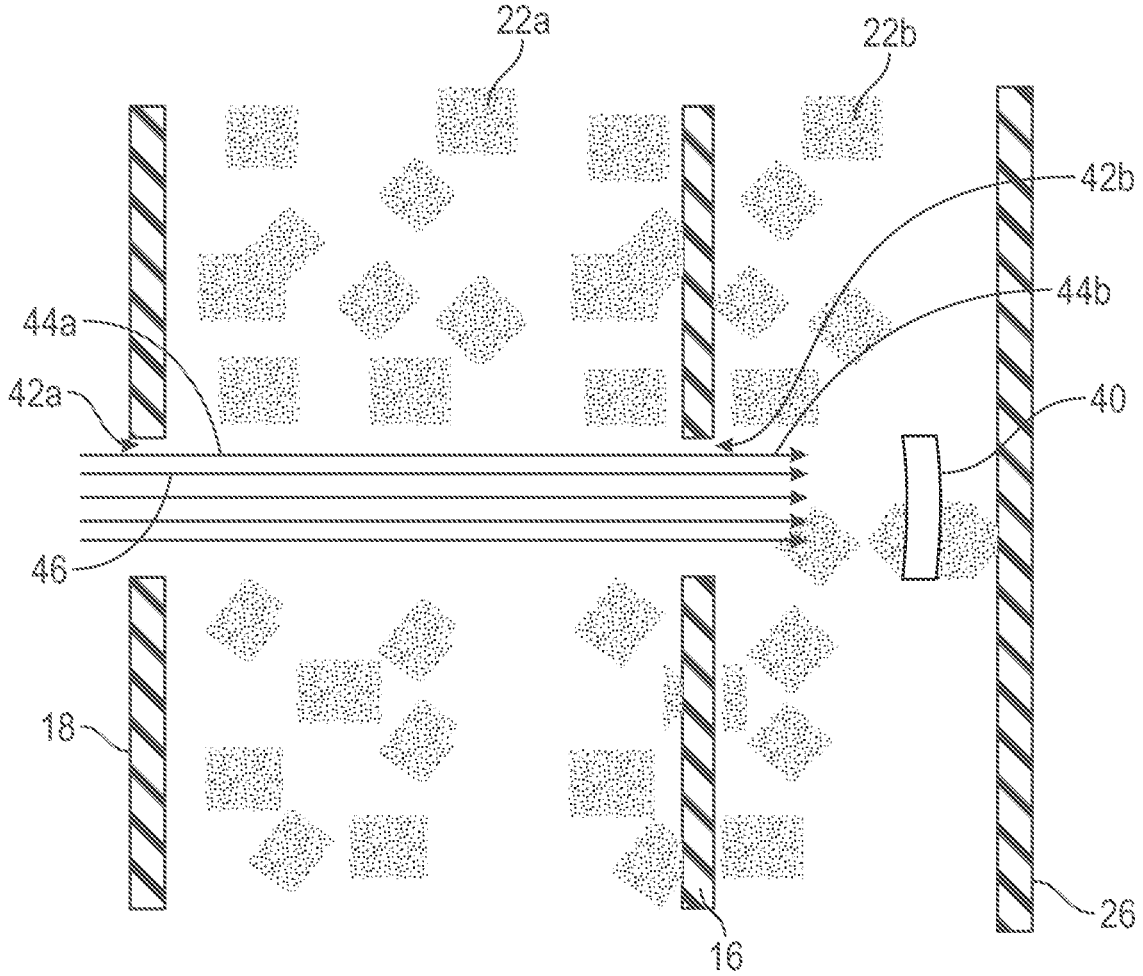
FIG. 4C is a side sectional view illustrating a method for disintegrating cement connecting three wellbore tubulars according to one embodiment of the present disclosure.

Referring to FIG. 4C, a shaped charge (not shown) may be ignited to generate a perforating jet 40 that creates an opening 42*a* in the inner wellbore tubular 18 and forms a tunnel 44*a* through the body of the cement 22*a*. The perforating jet 40 also creates an opening 42*b* in the secondary inner wellbore tubular 16 and forms a tunnel 44*b* through the body of the cement 22*b*. In embodiments, the perforating jet 40 does not penetrate through the outer wellbore tubular 26.

The propellant material (not shown) may be used to generate a high pressure gas 46 that flows through the opening 42*a* and into the tunnel 44*a*. The high pressure gas 46 pressurizes and breaks up the cement 22*a*. The high pressure gas 46 also flows through the opening 42*b* and into the tunnel 44*b*. The high pressure gas 46 pressurizes and breaks up the cement 22*b*.

From a functional standpoint, an integral cement body, while possibly having one or more fissures or broken pieces, has sufficient rigidity to prevent relative movement between the tubulars 16, 18 despite the application of a specified amount of tension to one or both of the tubulars 16, 18. In contrast, a cement body made up mostly of free particles allows such relative movement between the tubulars 16, 18 upon application of a specified tension loading to one or both of the tubulars 16, 18. That specified tension may be a fraction, e.g., 50%, of that needed to cause relative movement between the tubulars 16, 18 when connected by the integral body of cement 22.

Figure 5:
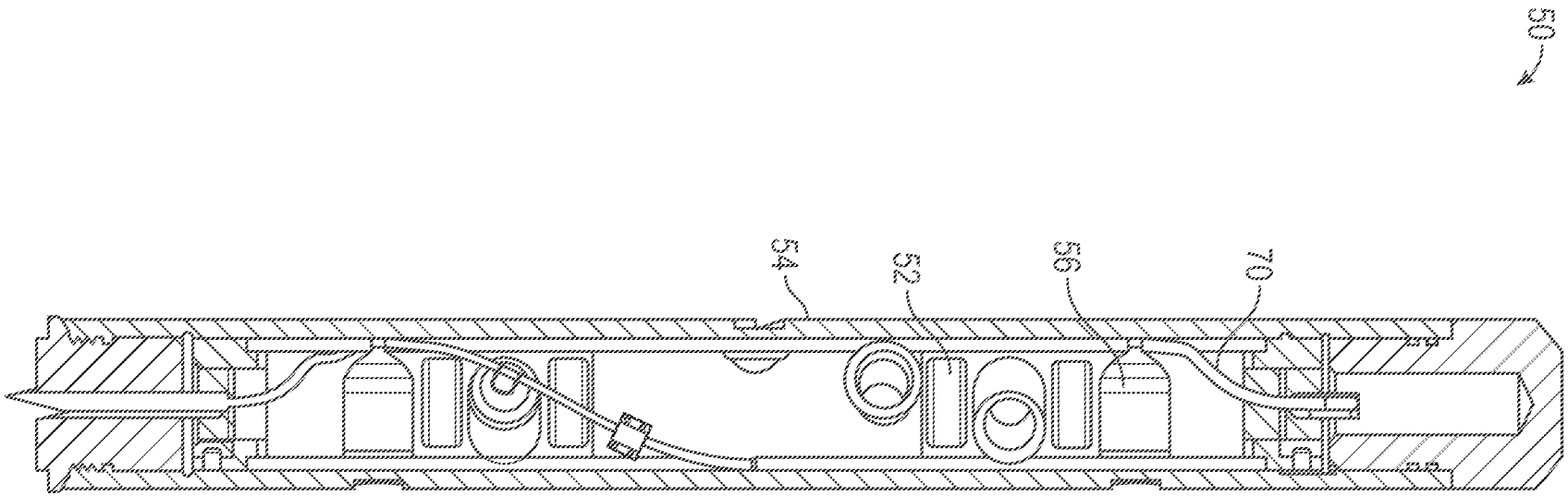
FIG. 5 schematically illustrates a well tool configured to disintegrate cement connecting two wellbore tubulars according to one embodiment of the present disclosure.

Referring to FIG. 5, there is schematically illustrated a well tool 50 for disintegrating the cement body 22 in accordance with one embodiment of the present disclosure. The well tool 50 may include one or more propellant bodies 52 that are disposed in a carrier 54 and adjacent to one or more shaped charges 56. The propellant bodies 52 may be formulated and configured to release gas at sufficient pressure and quantity to break up the cement 22 (FIG. 5). The propellant bodies 52 may be formed as pellets, capsules, disks, etc. In some embodiments, the propellant bodies 52 may be powderized and held within containers.

The propellant bodies 52 may include gas generating material(s) selected to generate gas at a sufficient pressure and volume to break-up the cement 22 (FIG. 1). The amount and make-up of the propellant capsules 52 may be selected by using historical data, experimentation, and/or analysis based on available information (e.g., known characteristics of the cement to be disintegrated, e.g., quantity, make-up, density, thickness, etc.).

Suitable propellants include, but are not limited to, a solid "oxidizer" component and a compound such as any nitramine type compound such as cyclotetramethylenetetranitramine (HMX), ammonium nitrate, diammonium bitetrazole, ammonium picrate, 1,2-dicyanotetranitroethane, hexanenitroethane, flourotrinitromethane and dihydrazinium 3,6-bis(5-tetrazoyl) dihydrotetrazine. Gas generating materials may also include thermites, PETN, HNS, RDX, black powder, BKNO3, TEFLON, perchlorates, aluminum, etc. Suitable gas generating materials may include components such as a solid oxidizer such as ammonium perchlorate or ammonium nitrate; a synthetic rubber such as HTPB, PBAN, polymers (e.g., polyurethane, polyglycidyl nitrate, etc.); and fuels such as nitroglycerin, and a metal such as aluminum.

The shaped charges 56 may be configured to create an opening in the inner wellbore tubular 18 but not the outer wellbore tubular 16, as shown in FIGS. 4A-B.

Figure 6:
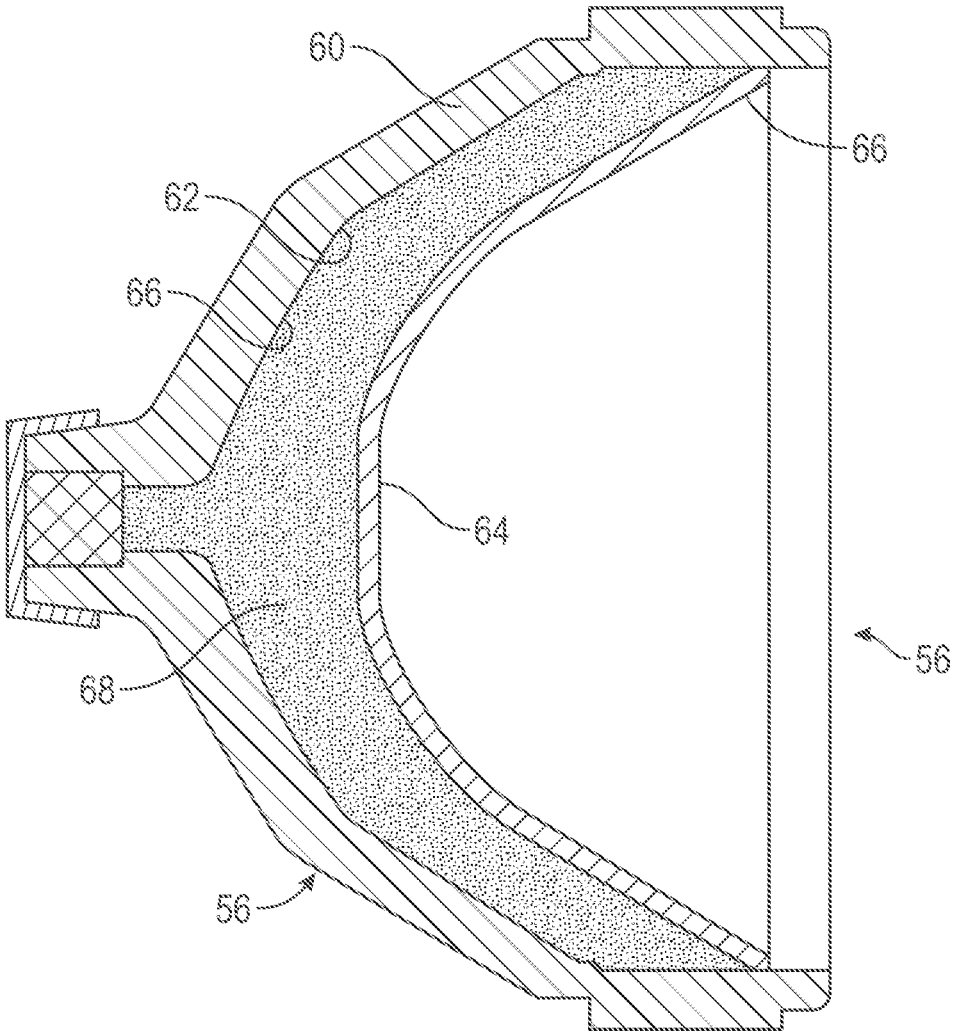
FIG. 6 is a sectional view of a shaped charge in accordance with one embodiment of the present disclosure.

Referring to FIG. 6, there is shown a cross section of an explosive shaped charge 56. The shaped charge 56 has a charge case 60. The charge case 60 has an interior surface or wall 62 that defines a hollow interior of the charge case 60. The charge case 60 is open at the outer end and tapers inward. Disposed within the interior of the case 60 is a liner 64. Disposed between the liner 64 and the interior wall 62 of the casing 60 is an explosive material 68. The case 42 receives a detonating cord 70 (FIG. 5) for detonating the explosive material 68.

One factor affecting depth of penetration is the material making up the liner 64. Conventionally, materials that tend to form a dense and compacted perforating jet are favored because of the traditional emphasis on depth of penetration. Embodiments of the present disclosure use materials that form a perforating jet that is less dense and relatively diffuse. Such a perforating jet exhausts energy while tunneling through the production structure and has insufficient mass to displace the formation. The liner 64 may be formed of materials such as aluminum, zinc, molybdenum, copper, magnesium, or other low density materials. In embodiments, the liner may also include low density materials such as thermoplastic polymers (PTFE, UHMW, etc).

Another factor effecting depth of penetration is liner shape or geometry. Liner shape can influence how and when the energy released by the explosive material interacts with the liner 64. For example, the liner 64 formed as a shallow bowl may form a perforating jet that is wider and flatter than a liner having an acute conical shape. Also, the liner may use shapes such as a truncated, parabolic, plugged apex, near EFP angled liner.

The case 60 may have a shape/geometry configured to limit the effective backup, which can then reduce the amount of energy imparted on the liner, which leads slower jet velocities and less penetration. The material of the case 60 may be steel (from solid or from Powered Metal), zinc, aluminum, glass, etc.

The explosive material 68 may include inert or energetic additives that will lower the detonation velocity. This will result in lower jet speed. Inert material may be binders such as wax and thermoplastic polymers, cellulose, etc.

Also, in some embodiments, the carrier 54 may include features that control the shape, velocity, or other characteristic of the jet 40 (FIG. 4A). For example, the carrier 54 may have scalloped sections, or reduced wall sections, that a jet 40 (FIG. 4A) may penetrate while losing less energy than a wall section that has not been reduced in thickness. Conversely, a wall section may be increased in thickness to reduce the energy of the jet 40.

In an illustrative mode of operation, the shaped charges 56 can be detonated by using a detonator cord 70 or other suitable device. In one arrangement, the propellant body 52 is not detonated by the detonator cord or other device but by the detonation of the shaped charge 56. That is, the detonation of the shaped charge 56 generates a shockwave that disintegrates the propellant body 52 into small free particles. Shockwaves are supersonic pressure waves. The shockwave also generates the jet 40 (FIG. 4A) that punctures an adjacent wellbore tubular. Additionally, the shaped charge 56 releases heat that ignites the disintegrated propellant body 52, which then generates the high pressure gas that flows through the opening in the wellbore tubular and acts on the cement. As noted above, there may be multiple propellant bodies 52 and shaped charges 56.

Figure 7:
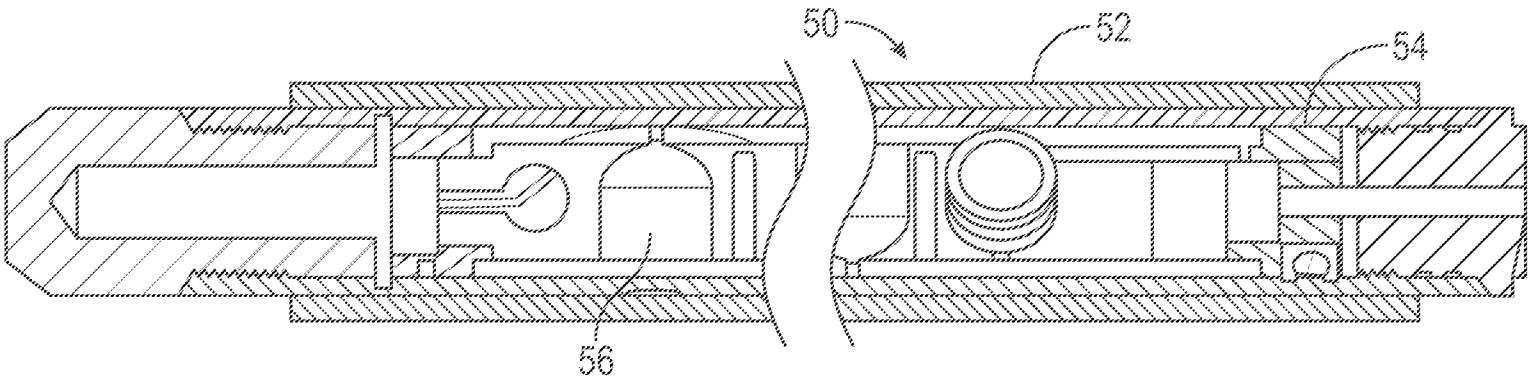
FIG. 7 schematically illustrates a well tool according to one embodiment of the present disclosure that uses an external propellant.
Figure 8:
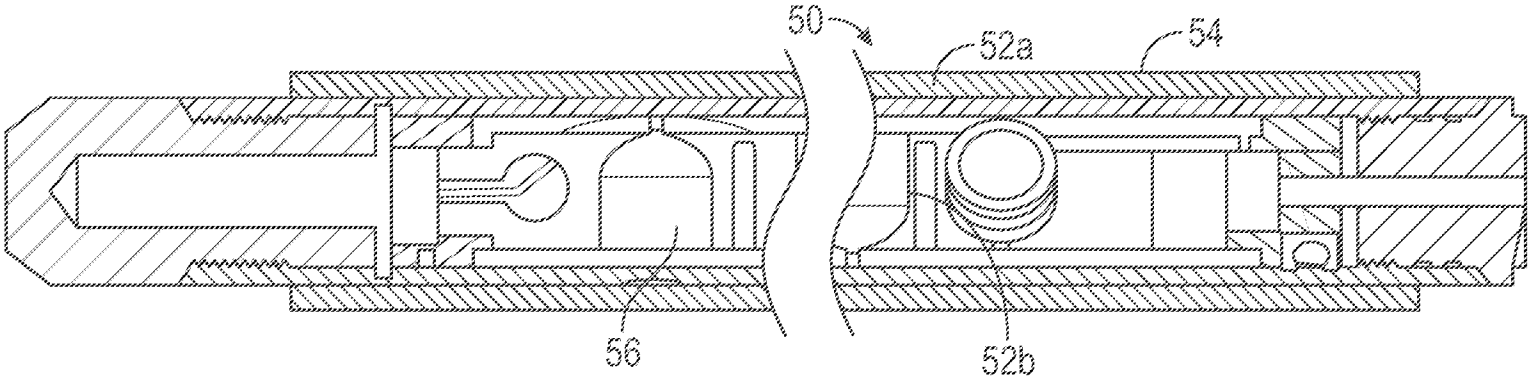
FIG. 8 schematically illustrates a well tool according to one embodiment of the present disclosure that uses an external propellant and an internal propellant.

The teachings of the present disclosure are susceptible to numerous embodiments. For example, referring to FIG. 7, there is shown another well tool 50 in accordance with the present disclosure. Similar to the FIG. 5 embodiment, the well tool 50 may include a carrier 54 that houses one or more shaped charges 56. In this variant, the propellant body 52 is formed as a sleeve that surrounds the carrier 54. The propellant sleeve 52 is broken up and ignited by the detonation of the shaped charges 56. Referring to FIG. 8, in still another embodiment, the well tool 50 may include an carrier 54 that houses one or more shaped charges 56. In this variant, the propellant is included as two separate bodies: a propellant 52*a* is formed as an external sleeve that surrounds the carrier 54 and a propellant 52*b* is an internal capsule.

Figure 9:
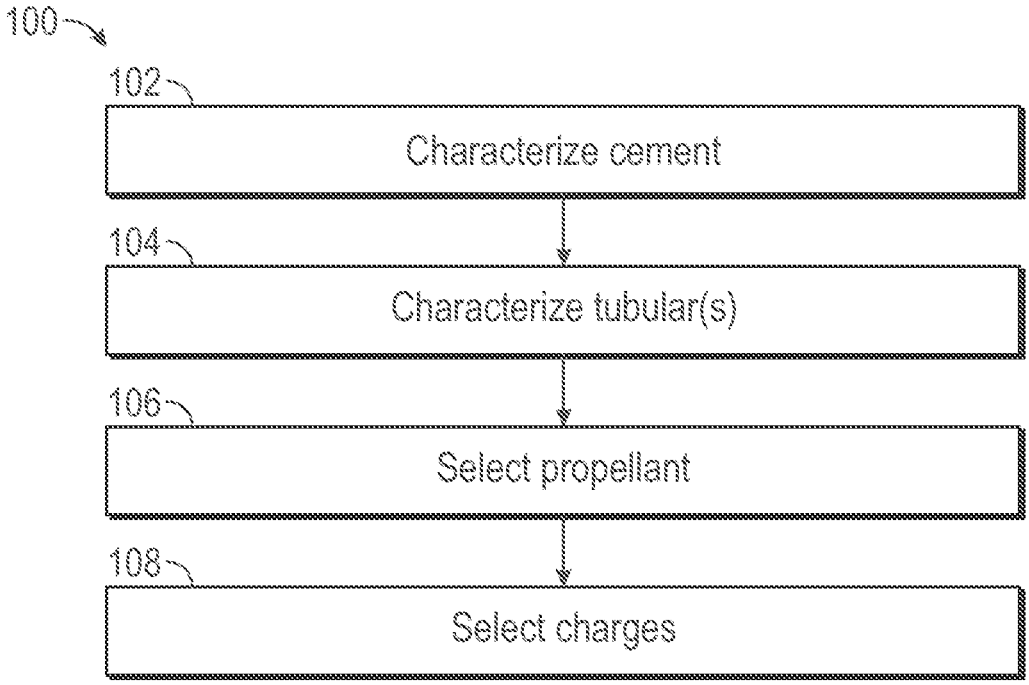
FIG. 9 depicts a flow chart of a method used to configure a well tool according to one embodiment of the present disclosure.

Referring to FIG. 9, there is shown a method 100 for configuring a well tool according to one embodiment of the present disclosure.

At step 102, a structural parameter of the cement connecting the tubulars in the wellbore is characterized to estimate strength and other material properties such as brittleness, ductility, porosity, etc. The information for this characterization may be obtained from manufacturer documentation, well logs, experimental data, computer modeling, etc. The characterization may also include dimensional data that may be used to estimate the volume of cement in the annular space between the tubulars.

At step 104, a structural parameter of one or more of the tubulars may be characterized to estimate strength, ductility, weakened locations, etc. The information for this characterization may also be obtained from manufacturer documentation, well logs, experimental data, computer modeling, etc. The characterization may also include dimensional data that may be used to estimate the thickness of the tubulars.

At step 106, the type and volume of propellant may be selected based on the characterizations of the cement and tubulars. Generally, the propellant may be selected to generate gas at a sufficient pressure and volume to break up the cement without bursting or otherwise damaging the tubulars or other structures in the wellbore.

At step 108, the shape charge may be selected to form an opening in the tubular to allow gas penetration into the annular space between the tubulars without compromising the integrity of the wellbore tubulars. Also, the shape change may be selected to ensure that the perforating jet does not pass through all of the tubulars making up the connection.

Figure 10:
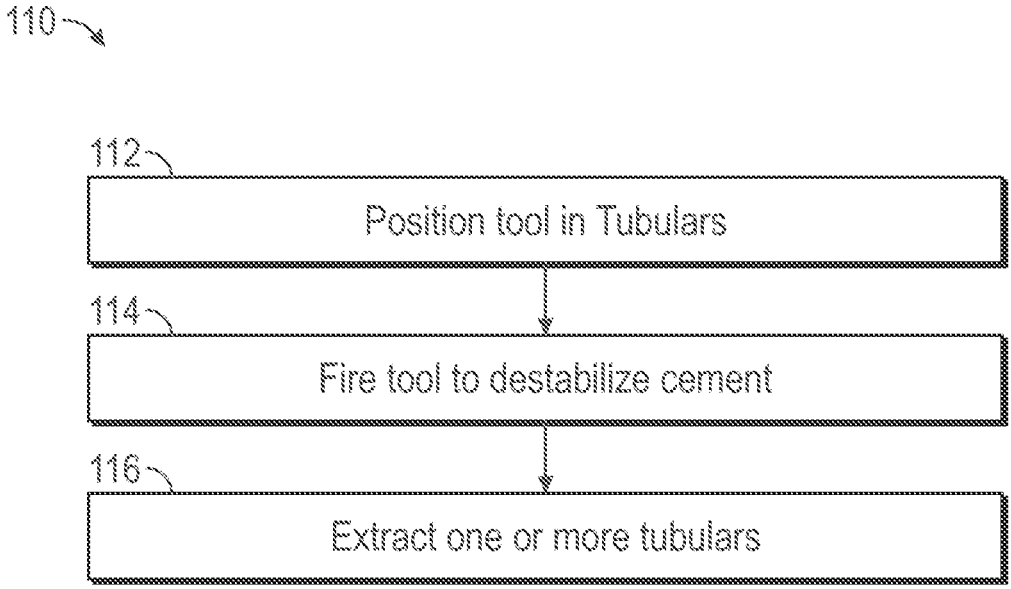
FIG. 10 depicts a flow chart of a method for extracting one or more wellbore tubulars using a well tool according to one embodiment of the present disclosure.

Referring to FIG. 10, there is shown a method 110 for using a well tool according to the present disclosure to extract one or more tubulars from a wellbore. Referring to FIGS. 1 and 10, at step 112, the well tool 50 (shown in hidden lines) is positioned at a depth proximate to the connected wellbore tubulars 16, 18. At step 114, the well tool 50 is activated. The jet 40 (FIG. 4A) formed by the shaped charges 56 (FIG. 5) punctures the inner tubular 16 and thereby allow high pressure gas 46 to flow into the annular space between the tubulars 16, 18 and break up the cement 22 as previously discussed in connection with FIGS. 4A and B. If needed, step 114 may be repeated. Additionally or alternatively, a jarring tool (not shown) may be also used to jar or shake the tubulars 16, 18 to further break up the cement 22. At step 116, one or more of the tubulars 16, 18 may be extracted from the wellbore.

Figure 11:
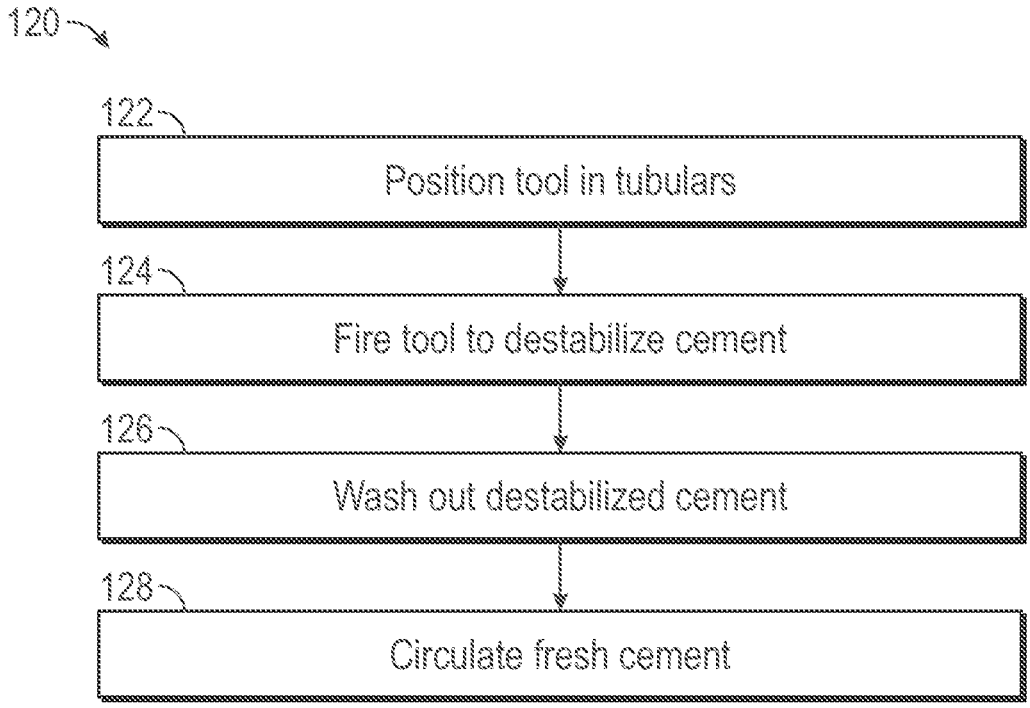
FIG. 11 depicts a flow chart of a method for re-cementing wellbore tubulars using a well tool according to one embodiment of the present disclosure.

Referring to FIG. 11, there is shown a method 120 for using a well tool according to the present disclosure to re-cement tubulars in a wellbore. Steps 122 and 124 are the same as steps 112 and 114, respectively, discussed above in connection with FIG. 10. At step 126, a completion tool (not shown) may be used to wash out the broken up cement 22 between the tubulars 16, 18. At step 128, the same tool or a different tool (not shown) may be used to direct fresh cement in place of the broken up cement 44.

Figure 12:
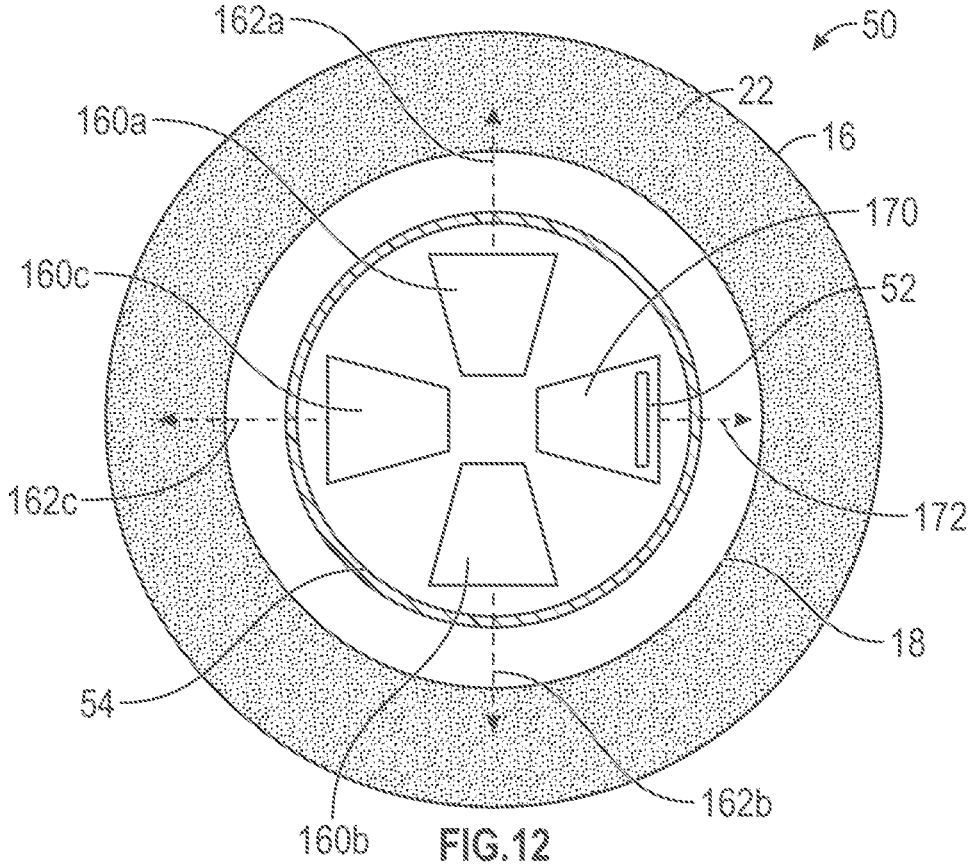
FIG. 12 schematically illustrates a well tool according to one embodiment of the present disclosure that uses phased perforating charges and puncturing charges.

Referring to FIG. 12, there is shown another non-limiting arrangement of a well tool 50 for disintegrating a cement body 22 connecting two wellbore tubulars in accordance with the present disclosure. The well tool 50 has a cluster of four charges: three perforating charges 160*a*, 160*b*, 160*c* and one puncturing charge 170. Thus, a majority of the charges are perforating charges and a minority of the charges are puncturing charges. The charges 160*a-c* and 170 have a 90 degree phase offset and follow a helical pattern. Thus, each charge 160*a-c* and 170 is at a different axial location.

The perforating charges 160*a-c* are configured to form jets 162*a-c*, respectively, that penetrate through the carrier 54 and the inner tubular 18. The 162*a-c* form tunnels in the cement 22 but do not penetrate through the outer tubular 16. The purpose of the jets 162*a-c* and how the tunnels enable high pressure gas to act on the cement 22 have already been discussed in connection with FIGS. 4A-C.

The puncturing charge 170 forms a jet 172 that penetrates through the carrier 54 but not the inner tubular 18. The purpose of the jet 172 is to provide a vent that enables the high pressure gas generated by a propellant 52 to rapidly exit the carrier 54.

Figure 13:
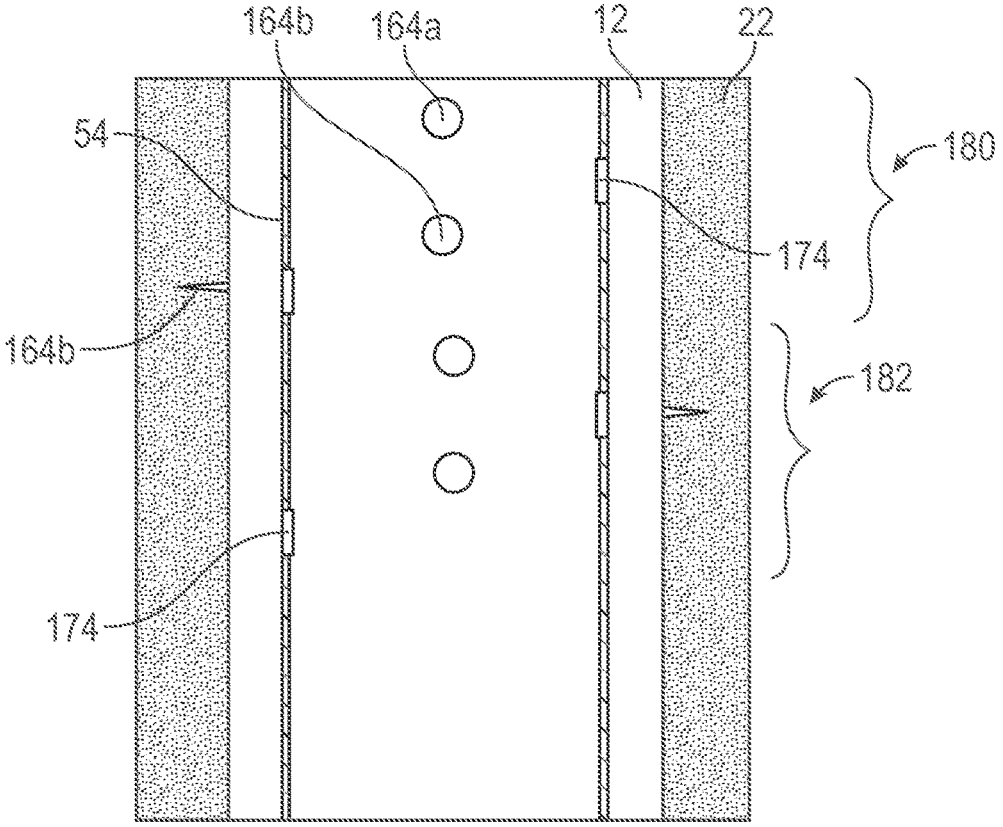
FIG. 13 schematically illustrates a shot pattern generated by the FIG. 12 embodiment.

Referring to FIG. 13, there is shown a elevation depiction of a shot pattern that may be obtained using the arrangement of FIG. 12. A shot pattern 180 generally corresponds to the 90 degree phase offset of the FIG. 12 perforating charges

160*a-c* and puncturing charge 170. The perforating charge 160*a* creates a corresponding tunnel 164*a* through the carrier 54 and at least partially into the cement 22. The perforating charge 160*b* creates a corresponding tunnel 164*b* through the carrier 54 and at least partially into the cement 22. The perforating charge 160*c* creates a corresponding tunnel 164*c* through the carrier 54 and at least partially into the cement 22. In contrast, the puncturing charge 170 creates a corresponding opening 174 only through the carrier 54.

Referring to FIGS. 12 and 13, the well tool 50 may have multiple adjacent clusters. These clusters may or may not use the same pattern. For example, a shot pattern 182 may be obtained by reordering the perforating charges 160*a*, 160*b*, 160*c* and puncturing charge 170 such that the puncturing charge 170 is at a different phased orientation relative to a puncturing charge (not shown) of an adjacent cluster (not shown) and thus vents high-pressure gas to a different sector of wellbore 12. For example, as shown, openings 174 have been created at 180 degree offsets. However, the angular offset of the openings 174 may be varied as needed; e.g., 30 degrees, 45 degrees, 90 degrees, etc. The openings 174 may be oriented to allow a relatively even venting of high pressure gas both axially along the length of the well tool 50 and about the circumference of the well tool 50. It should be appreciated that axially and circumferentially distributing the openings 174, the pressure applied by the high pressure gas can be more uniformly applied to the cement 22 can thereby result in a more uniform disintegration of the cement 22.

In another arrangement not shown, a cluster of eight charges may have a 45 degree phase offset. In such an arrangement, the number of puncturing charges is between 1-3, i.e., a minority of the total number of charges. In yet another arrangement not shown, a cluster of three charges may have a 120 degree phase offset. In such an arrangement, the number of puncturing charges is 1. Thus, in all such clusters, a majority of the charges are perforating charges and a minority of the charges are puncturing charges.

Figure 14:
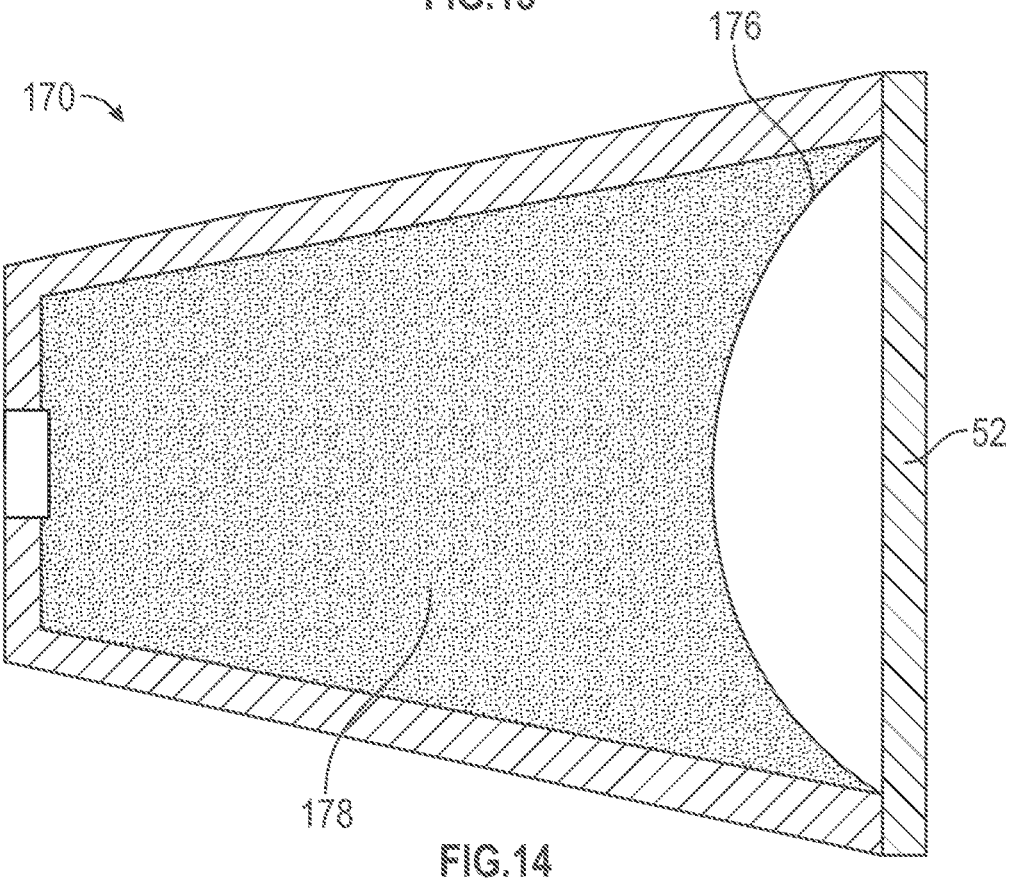
FIG. 14 schematically illustrates a puncturing charge according to one embodiment of the present disclosure.

Referring to FIG. 14, there is shown a cross section of a non-limiting embodiment of a puncturing charge 170 according to the present disclosure. The puncturing charge 170 is configured to detonate the propellant body 54 (FIG. 12) and form only the opening 174 (FIG. 13) in the carrier 54 (FIG. 13). The puncturing charge 170 is generally similar to the shaped charge 56 shown in FIG. 6. However, certain structures may be varied to obtain a jet that punctures an adjacent tubular without proceeding further into adjacent structures or the formation. For example, the shape, size, density, and/or material composition of the liner 176 and the quantity and formulation of the explosive material 178 may configured to generate a jet (not shown) that has only enough energy to detonate the adjacent propellant body 52 and form the opening 174 (FIG. 13). Generally known "punch charges" may be utilized to provide a jet of the desired characteristics.

In other embodiments, the propellant body 52 may surround the puncturing charge 170 or be formed as a sleeve disposed inside the carrier. Further, in some embodiments, the jet of the puncturing charge 170 does not contact the propellant material 52. Instead, the jet only creates the opening 174 (FIG. 12) and the heat and shockwaves released by the energetic material 178 detonates the propellant body 52.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

The invention claimed is:

1. A method of remediation in a subterranean formation having a borehole in which a first wellbore tubular is disposed at least partially within a second wellbore tubular, and wherein a cement body connects the first wellbore tubular to the second wellbore tubular, comprising:

positioning a well tool in a bore of the first wellbore tubular, the well tool having at least one shaped charge and at least one propellant body disposed inside a carrier;

detonating the shaped charge to generate a jet that forms an opening in the carrier, the first wellbore tubular, and a tunnel at least partially in the cement body, but does not form an opening in the second wellbore tubular;

igniting the propellant body to generate a gas at a volume and pressure selected to disintegrate the cement body; and washing out the disintegrated cement body.

2. The method of claim 1, wherein the propellant body is ignited by heat released by the detonated shaped charges and shock waves generated by the detonated shaped charges.

3. The method of claim 1, further comprising directing fresh cement between the first and the second wellbore tubulars.

4. The method of claim 1, further comprising retrieving from the borehole at least one of: (i) the first wellbore tubular, and (ii) the second wellbore tubular.

5. The method of claim 1, wherein the gas generated by the propellant body disintegrates the cement body such a tension applied to at least one of the first and the second wellbore tubulars needed to cause relative movement between the first and the second wellbore tubulars is reduced by at least fifty percent.

6. The method of claim 1, further comprising characterizing at least one structural parameter of the cement body.

7. The method of claim 6, wherein the characterized structural parameter is used to select at least one of: (i) a type of propellant, and (ii) a volume of propellant.

8. The method of claim 1, further comprising characterizing at least one structural parameter of one of: (i) the first wellbore tubular, and (ii) the second wellbore tubular.

9. The method of claim 8, wherein the characterized structural parameter is used to select at least one of: (i) a type of propellant, and (ii) a volume of propellant.

10. The method of claim 1, wherein the well tool has a punch charge, and further comprising detonating the puncture charge, wherein a jet formed by the puncture charge only forms an opening in the carrier and does not form an opening in the first wellbore tubular or the second wellbore tubular.

11. An apparatus for remediating a subterranean formation having a borehole in which a first wellbore tubular is disposed at least partially within a second tubular, and wherein a cement body connects the first wellbore tubular to the second wellbore tubular, comprising:

a carrier;

a plurality of perforating charges disposed in the carrier and configured to only penetrate through the first wellbore tubular and at least partially through the cement body and not penetrate through the second wellbore tubular; and a propellant body disposed in the carrier and configured to be detonated by the at least one perforating charges puncturing charge, wherein an amount of the propellant body is determined by characterizing at least one structural parameter of the cement body.

12. The apparatus of claim 11, wherein the propellant body is ignited by heat released by the detonated shaped charges and shock waves generated by the detonated shaped charges.

13. The apparatus of claim 11, further comprising: at least one puncturing charge disposed in the carrier and configured to penetrate only through the carrier, wherein the number of at least one puncturing charges is less that the number of perforating charges.

14. A method of remediation in a subterranean formation having a borehole in which a first wellbore tubular is disposed at least partially within a second wellbore tubular, and wherein a cement body connects the first wellbore tubular to the second wellbore tubular, comprising:

characterizing at least one structural parameter of the cement body, positioning a well tool in a bore of the first wellbore tubular, the well tool having at least one shaped charge and at least one propellant body disposed inside a carrier;

detonating the shaped charge to generate a jet that forms an opening in the carrier, the first wellbore tubular, and a tunnel at least partially in the cement body, but does not form an opening in the second wellbore tubular; and igniting the propellant body to generate a gas at a volume and pressure selected to disintegrate the cement body.

15. The method of claim 14, wherein the characterized structural parameter is used to select at least one of: (i) a type of propellant, and (ii) a volume of propellant.

16. The method of claim 14, further comprising characterizing at least one structural parameter of one of: (i) the first wellbore tubular, and (ii) the second wellbore tubular.

17. The method of claim 14, wherein the well tool has a punch charge, and further comprising detonating the puncture charge, wherein a jet formed by the puncture charge only forms an opening in the carrier and does not form an opening in the first wellbore tubular or the second wellbore tubular.

* * * * *